US007251339B2

(12) United States Patent
Ryan

(10) Patent No.: US 7,251,339 B2
(45) Date of Patent: Jul. 31, 2007

(54) WIRELESS REMOTE CONTROL FOR A HEARING INSTRUMENT

(75) Inventor: James Gregory Ryan, Ottawa (CA)

(73) Assignee: Gennum Corporation (CA)

( * ) Notice: Subject to any disclaimer, the term of this patent is extended or adjusted under 35 U.S.C. 154(b) by 290 days.

(21) Appl. No.: 10/815,051

(22) Filed: Mar. 31, 2004

(65) Prior Publication Data

US 2004/0196993 A1 Oct. 7, 2004

Related U.S. Application Data

(60) Provisional application No. 60/459,564, filed on Apr. 1, 2003.

(51) Int. Cl.
*H04R 25/00* (2006.01)

(52) U.S. Cl. ..... 381/315; 367/197

(58) Field of Classification Search ..... 381/315; 367/197, 199

See application file for complete search history.

(56) References Cited

U.S. PATENT DOCUMENTS 3,628,499 A * 12/1971 Benford ..... 367/197

4,790,019 A * 12/1988 Hueber ..... 381/315

OTHER PUBLICATIONS

User's Manual for Fisher-Price "Play with Letters Desk", 16 pages, 2001.

Website print out from www.phonak.com/consumer/products/accessories/remote.htm, "Phonak Remote Controls at a Glance," 2 pages, printed from internet on Dec. 9, 2005.

User's Manual for Phonak hearing systems, "Remote Control WatchPilot 2 User Guide," 18 pages, undated.

User's Manual for Phonak hearing systems, "Remote Control SoundPilot User Guide," 20 pages, undated.

* cited by examiner

*Primary Examiner*—Daniel Swerdlow
(74) *Attorney, Agent, or Firm*—Jones Day

(57) ABSTRACT

A remote control for programming a hearing instrument includes a housing and a mechanism associated with the housing for mechanically generating an acoustical pulse for effecting control of a hearing instrument. The remote control is passive. A hearing instrument system includes a hearing instrument having a microphone and programming, and the remote control. The programming is configured to interpret the acoustical pulse generated by the mechanism to effect control of the hearing instrument.

18 Claims, 3 Drawing Sheets

WIRELESS REMOTE CONTROL FOR A HEARING INSTRUMENT

CROSS-REFERENCE TO RELATED APPLICATION

This application claims priority to U.S. Provisional Application No. 60/459,564, filed on Apr. 1, 2003, the disclosure of which is incorporated herein by reference in its entirety.

FIELD

This technology relates to a hearing instrument. In particular, the technology concerns a remote control for programming a hearing instrument.

BACKGROUND

Hearing instruments are currently programmable and include instrumentation or programming for volume control and program or mode selection, such as directional/non-directional usage, musical usage, quiet listening usage, etc. Other options may also be programmed into a hearing instrument, as known by those of skill in the art. An audiologist typically initially programs the hearing instrument based upon user preferences. User's also may program the devices themselves. For example, users may desire to increase or decrease the volume of the hearing instrument, or to select different modes based upon their field of usage.

Because of the small size of hearing instruments, user activated controls are difficult to provide. Where controls are provided, they are often difficult to use because of the small size of the hearing instrument, especially for users having limited dexterity. Many companies are researching the use of radio-frequency wireless remote controls. These devices, however, require significant changes to the design of the hearing instrument, including the addition of antennae and RF circuitry. In addition, the remote control device used for programming requires a radio-frequency transmitter that can consume significant electrical power and suffer from short battery life. One company utilizes a wrist watch remote control that transmits RF signals to a hearing instrument.

SUMMARY

In accordance with the teachings described herein, a remote control for programming a hearing instrument comprises a housing and a mechanism associated with the housing for mechanically generating an acoustical pulse for effecting control of a hearing instrument. The mechanism may be passive.

In one embodiment, the mechanism is a finger actuatable member coupled to a reed. The mechanism may comprise at least one cogged wheel that is rotationally positioned in the housing and at least one reed cantilevered to contact each cogged wheel. Each coupled wheel and reed are together configured to generate an acoustical pulse upon rotation of the wheel against the reed. The reed may be fixed to a surface inside the housing.

The at least one cogged wheel may comprise a plurality of cogged wheels, with each wheel being coupled to the at least one reed for generating a unique acoustical pulse associated with each of the plurality of cogged wheels. The plurality of cogged wheels may include at least a first cogged wheel, a second cogged wheel, and a third cogged wheel, with the first cogged wheel having a first spacing of cogs on the wheel, the second cogged wheel having a second spacing of cogs on the wheel, and the third cogged wheel having a third spacing of cogs on the wheel. In a preferred embodiment, the first, second, and third spacings are different from one another. The acoustical pulses may be emitted in sequence with the spacings of the respective cogs.

In another embodiment, the mechanism comprises at least one sliding push button having a surface treatment coupled to a reed for generating an acoustical pulse upon movement of the push button. The sliding push button may comprise a bar-like member having a cogged surface, with the reed being cantilevered in the housing so that one end of the reed is associated with the cogged surface for vibratory movement relative thereto. The at least one sliding push button may comprise a plurality of push buttons.

In another example, a hearing instrument system comprises a hearing instrument having a microphone and programming, and the remote control discussed above. The programming is configured to interpret the acoustical pulses to effect control of the hearing instrument.

In yet another example, a hearing instrument system comprises a hearing instrument having programming and a wireless remote control configured to emit a mechanically generated acoustical pulse. The programming of the hearing instrument is configured to interpret the acoustical pulse to program the hearing instrument.

The programming of the hearing instrument may include one of a decoding circuit and decoding software for interpreting the acoustical pulse generated by the remote control. The decoding circuit or decoding software includes a high pass filter for removing interfering energy, a full-wave rectifier followed by a low-pass filter for transforming the acoustical pulses into base band pulses, and programming for measuring the time spacing of the acoustical pulses to verify that the received pulses match a pulse pattern associated with a command for the hearing instrument. The hearing instrument may also include programming for disabling the decoding circuit. The programming for disabling the decoding circuit may comprise means for calculating a pulse-to-noise ratio at the output of the low-pass filter to determine whether the pulse-to-noise ratio exceeds a predetermined threshold.

In one embodiment of the system, the wireless remote control is passive and the hearing instrument includes a built-in microphone. The microphone is configured to accept the acoustical pulses from the remote control to effect control of the hearing instrument.

In another example, a method for controlling a hearing instrument comprises generating a remote acoustical pulse, receiving the acoustical pulse through a microphone of a hearing instrument, decoding the acoustical pulse in a program of a hearing instrument, and controlling the hearing instrument based upon the decoded acoustical pulse.

The decoding the pulse step may comprise utilizing a decoding circuit or decoding software programmed in the hearing instrument. The decoding the pulse step may further comprise high-pass filtering the acoustical pulses received by the microphone to remove interfering energy, full-wave rectifying and low-pass filtering the acoustical pulses into base band pulses, and determining the time spacing of the band pulses to verify that the band pulses match a pattern associated with a command for the instrument. The method may also include disabling the decoding step by determining that a false triggering has occurred, with the false triggering being determined by calculating a pulse-to-noise ratio and comparing the ratio to a predetermined threshold.

BRIEF DESCRIPTION OF THE DRAWING FIGURES

DETAILED DESCRIPTION

Figure 1:
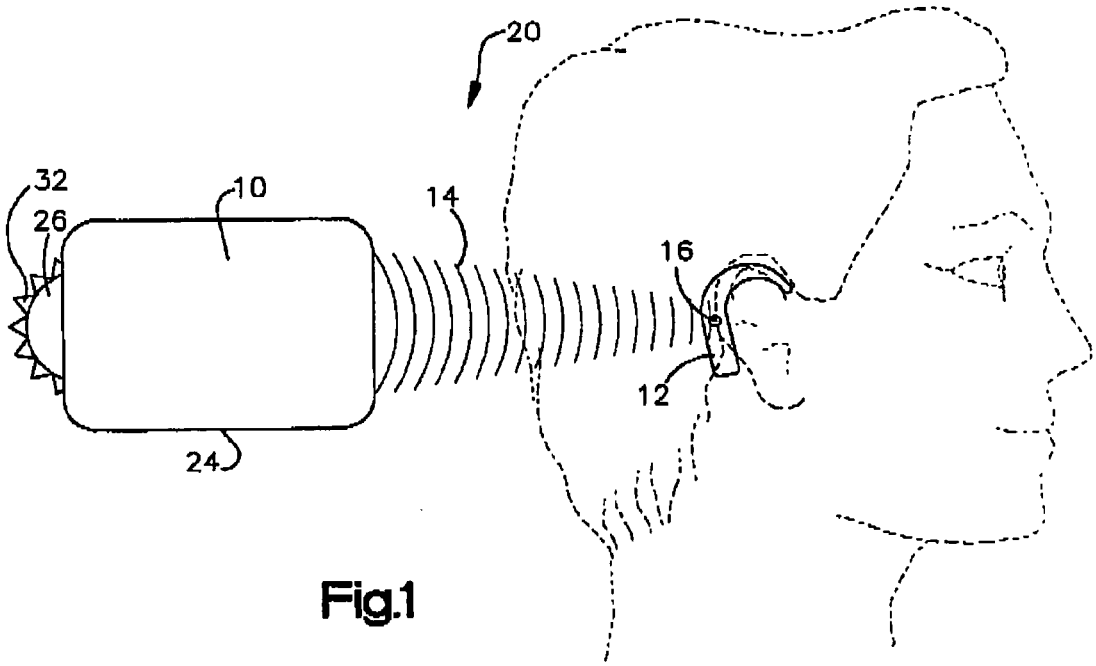
FIG. 1 is plan view of an example hearing instrument system where a wireless remote control is in communication with a hearing instrument.

The example remote control 10 is a wireless device that communicates with a hearing instrument 12, such as a hearing aid or a headset, to effect control of the hearing instrument 12. The remote control unit 10 is an easily operated, passive device that does not require electrical power for operation. In addition, because the example remote control 10 operates without battery power, the cost of the device is relatively low.

The remote control 10 effects control of a hearing instrument 12 by emitting coded acoustical pulses or clicks 14. These pulses or clicks 14 are received by the hearing instrument's microphone 16 and decoded to determine the control requested by the user. The term "acoustical pulse," as used herein, is meant to refer generically to any type of acoustical pulse, click, noise, broadband signal, or otherwise. The example remote control 10 accomplishes programming of the hearing instrument 12 with very limited modification of the hearing instrument 12. The required modifications include the addition of audio-frequency circuitry or software that is used to decode the acoustical pulse train.

Hearing instruments 12 typically include programming such as volume control and program selection, among other known programming. Program selection may include selecting between different environments, which have different electroacoustic settings. For example, the user may select between music, ambient noise, quiet listening, listening in automobiles, etc. The user may select a directional microphone, or a non-directional microphone. User's often also prefer to be able to control the volume of the hearing instrument 12. The example remote control 10 preferably is configured to produce a number of different acoustical pulses, so that more than one programming feature may be provided from a single remote control 10. Decoding circuitry 18 in the hearing instrument 12 is configured to interpret which coded acoustical pulse train is being generated by the remote control 10 and to program the hearing instrument 12 based upon the coded pulse.

The example remote control 10 may be utilized for the initial programming of a hearing instrument 12 by an audiologist, or by a user who wishes to reprogram certain features of the instrument 12 after the initial programming has already taken place. The audiologist may be privy to more programming functions than the user by providing a remote control 10 that is capable of producing a greater number of acoustic pulses 14. By using the example remote control 10, the audiologist may avoid having to connect the hearing instrument 12 to a computer during the initial programming. The audiologist may also program the hearing instrument 12 to filter out certain frequencies of noise in order to cater the hearing instrument 12 to the user's particular hearing loss. There are several ways to program the hearing instrument 12. One way is through an index mode, where the user cycles through a program from one to the next by repeatedly generating an acoustic pulse sequence 14. Alternatively, individual programs may be selected by utilizing different pulse sequences 14.

Figure 8:
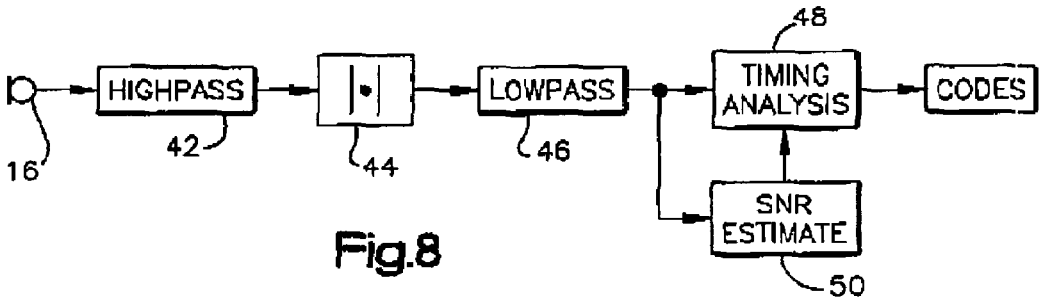
FIG. 8 is a schematic representation of a decoding circuit or decoding software for use in a hearing instrument.

Referring to FIG. 1, a hearing instrument system 20 includes a remote control 10 that produces a coded sequence of acoustic pulses 14 under mechanical control. The acoustic pulses 14 are received by the microphone 16 of the hearing instrument 12. The hearing instrument 12 is preferably digital and includes programming for interpreting the acoustic pulses 14 received through the microphone 16. In particular, the hearing instrument 12 includes circuitry or programming to decode the acoustic pulse train, such as shown in FIG. 8.

Figure 2:
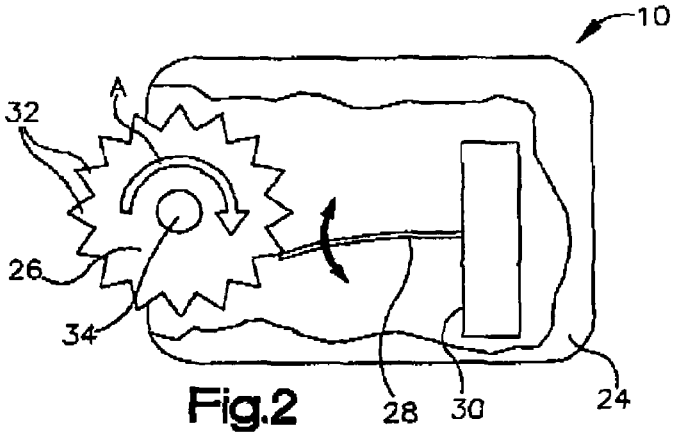
FIG. 2 is a side view of an example wireless remote control showing a portion of the housing cut away to reveal the interior of the housing.
Figure 3:
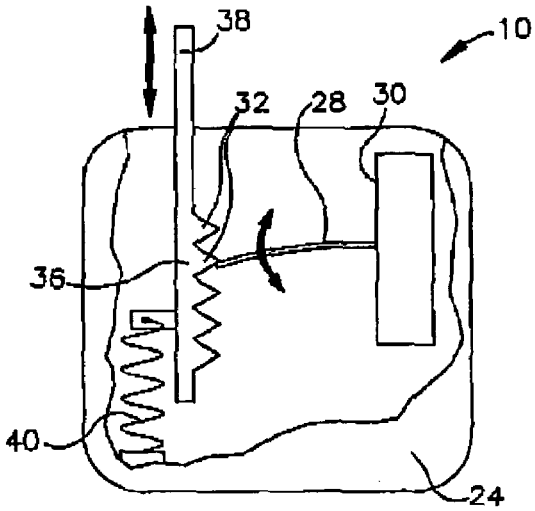
FIG. 3 is a side view of another example wireless remote control showing a portion of the housing cut away to reveal the interior of the housing.

The wireless remote control 10 is a handheld device. Two different embodiments of the remote control 10 are shown in FIGS. 2 and 3. In the first embodiment of FIG. 2, the remote control 10 includes a housing 24, a cogged wheel 26, and a reed 28. The housing 24 contains the reed 28 and at least part of the cogged wheel 26. The cogged wheel 26 includes cogs having a predetermined spacing that coincides with a coded sequence of acoustical pulses 14. The reed 28 is cantilevered from a surface 30 inside the housing 24 so that the free end of the reed 28 engages the cogs 32 on the cogged wheel 26. When the user rotates the cogged wheel 26, such as in direction A, cogs 32 on the wheel 26 strike the vibrating reed 28 and cause the reed 28 to emit acoustic pulses 14 in sequence with the physical spacing of the cogs 32 on the wheel 26. The acoustical pulses 14 are audible to the user and to the microphone 16 of the hearing instrument 12. The cogged wheel 26 is preferably installed for rotation on a post 34 that is coupled to the housing 24 by any known means. In an alternative embodiment, a thumb wheel (not shown) may be linked mechanically to the cogged wheel 26 so that the user contacts the thumb wheel to rotate the cogged wheel 26. In this manner, physical interaction with the roughness of the cogged wheel 26 may be avoided.

FIG. 3 shows another embodiment of the handheld remote control 10 configured to generate acoustical pulses 14. The remote 10 includes a housing 24, a slide bar 36 with a push button 38, a reed 28, and a spring 40. The housing 24 surrounds at least part of the slide bar 36, the reed 28, and the spring 40. The slide bar 36 is slideable up and down within the housing 24 and includes a series of spaced cogs 32 on the surface of the slide bar 36. The push button 38 is positioned at the outer end of the slide bar 36 and is configured for engagement by a finger of a user. The reed 28 is cantilevered from a surface 30 inside the housing 24 so that the free end of the reed 28 engages the cogs 32 on the slide bar 36. In operation, the user pushes down on the push button 38 so that the slide bar 36 moves downwardly in the housing 24. As the slide bar 36 moves downwardly, the reed 28 vibrates against the cogs 32 and an acoustical pulse train is generated. The spring 40 is used to return the push button 38 to an original position so that it may again be depressed.

Alternatively, the spring 40 may be absent and the user can both push and pull the push button 38 to return it to its original position.

In yet another embodiment, which is not shown, the slide bar 36 may extend from both sides of the housing 24 so that the user puts a thumb on one end of the slide bar 36 and a finger on the other end and pushes the bar 36 back and forth between the sides of the housing 24. Other alternative embodiments may also be utilized to mechanically generate acoustical pulses, the examples not being limited to the depicted embodiments.

Figure 4:
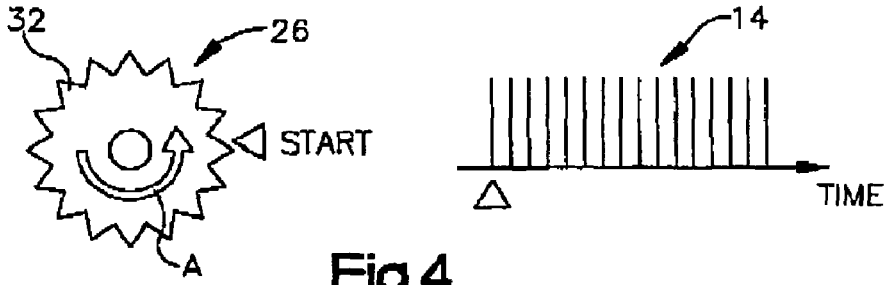
FIG. 4 is a schematic representation of a click sequence for an example wireless remote control.
Figure 5:
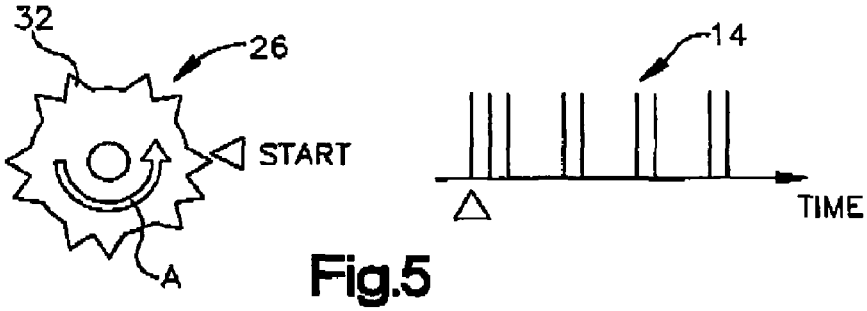
FIG. 5 is a schematic representation of another click sequence for an example wireless remote control.
Figure 6:
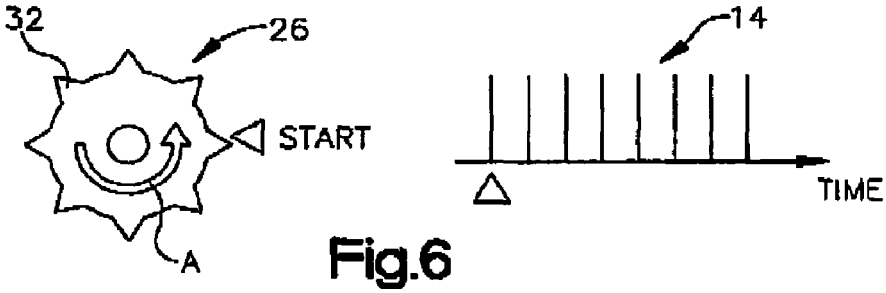
FIG. 6 is a schematic representation of yet another click sequence for an example wireless remote control.
Figure 7:
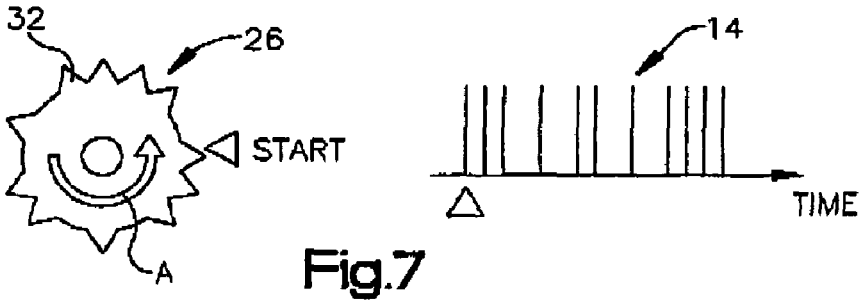
FIG. 7 is a schematic representation of a further click sequence for an example wireless remote control.

Different coded pulse sequences may be produced by simply changing the physical spacing on the cogs 32 on the wheel 26 or slide bar 36. In fact, a single handheld remote control 10 can be equipped with several wheels 26 or slide bars 36 or both to permit the transmission of multiple coded sequences. FIGS. 4-7 depict the generation of different pulse sequences based upon the usage of different cog 32 spacings on a cogged wheel 26. FIGS. 4 and 6 depict constant pulse sequences, where the cogs 32 on the wheels 26 are evenly spaced around the circumference of the wheels 26. FIG. 5 depicts a pulse sequence that includes changes in the pulse sequence upon every complete rotation of the cogged wheel 26 past a start position. For example, the wheel 26 of FIG. 5 generates a series of two pulse strokes, with a three pulse stroke near the start position. FIG. 7 depicts an alternative pulse sequence where the sequence varies from a single to a quadruple pulse. Any variety of pulse sequences may be utilized. Advantageously, the design of the cogs 32 and the vibrating reed 28 can be tailored to produce acoustical pulses 14 having a spectral content that facilitates detection in noisy acoustic environments.

In an example for controlling the volume of a hearing instrument 12, a remote control having a single wheel 26 can be utilized with an indexed programming for volume control. The user may rotate the wheel 26 in a first direction to incrementally increase volume and in an opposite direction to incrementally decrease volume. In this example, the cogged wheel pattern is directional, so that a first pulse sequence is generated when the wheel 26 is rotated in the first direction and a second pulse sequence is generated when the wheel 26 is rotated in the second, opposite direction.

In another example remote control 10, multiple wheels 26 may be provided within a single housing 24. A single reed 28 may be used to contact all the wheels 26, or individual reeds 28 may be utilized to contact each individual wheel 26. In this example, one wheel 26 is used for volume control and the other wheels 26 are used for memory selection.

FIG. 8 depicts a decoding circuit or software 18 that decodes the acoustical pulses 14 that are generated by the remote control 10 and received by the microphone 16 of the hearing instrument 12. The remote 10 can be used to generate pulse sequences that have a variety of acoustical energy contents. In one embodiment, for acoustical pulses 14 having significant acoustical energy content above 4 kHz (coinciding with the frequency ascribed to speech), for example, a circuit or software 18 may be utilized, such as shown in FIG. 8. In this circuit or software 18, the audio signal from the microphone 16 first passes through a high-pass filter 42 to remove interfering audio-signal energy, such as speech, for example. The microphone 16 may be directional or non-directional. Then, a full-wave rectifier 44 followed by a low-pass filter 46 can be used to transform the high frequency acoustical pulses 14 into base band pulses. The rectifier 44 is used to convert AC signals to pulse signals and the low-pass filter 46 is used to smooth out the pulse signals. The time spacing 48 of the pulses is then measured to verify that the received acoustic pulse sequence matches a programmed pulse sequence associated with a command for the hearing instrument 12. False triggering of the hearing instrument 12 programming can be reduced by calculating the signal-to-noise ratio 50 of the pulse sequence at the output of the low-pass filter 46. If the signal-to-noise ratio 50 does not exceed a predetermined threshold level, the decoded circuit 18 is disabled.

While the above example was provided in connection with acoustical energy content having a frequency of 4 kHz or higher, the decoding circuit or software may be utilized with any type of frequency level energy content, including acoustical energy content have a frequency that is less than 4 kHz.

The hearing instrument 12 is preferably programmed to interpret the incoming acoustic pulses 14 without dependency on the speed of rotation of the cogged wheel 26. For example, the hearing instrument 12 can include programming that determines the coded sequence by first timing the time between the first several pulses, and then matching this timing to a coded sequence, taking into account the speed of rotation. Therefore, it is preferred that the programming in the hearing instrument 12 be capable of adapting to changes in the rate of rotation of the wheel 26.

The housing 24 of the remote control 10 can be used for indicia (not shown). Types of indicia include advertising indicia, instructional indicia, or otherwise. The examples described herein may be utilized with any type of hearing instrument 12, including both an in-the-ear model or a behind-the-ear model.

While the cogged wheel 26 has been described in connection with many of the embodiments depicted herein, it should be understood that other types of moving devices may also be used, the invention not being limited particularly to a cogged wheel design. While the remote control 10 described herein is passive and mechanical in nature, an alternative pulse generating device could also be utilized, such as an electroacoustic device, that digitally generates acoustic pulse sequences utilizing battery power.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A hearing instrument system comprising:

a hearing instrument having programming;

a wireless remote control configured to emit a mechanically generated acoustical pulse, wherein the programming of the hearing instrument is configured to interpret the acoustical pulse to program the hearing instrument, and wherein the programming is disabled when a calculated pulse-to-noise ratio does not exceed a predetermined threshold.

2. The hearing instrument system of claim 1, wherein the programming of the hearing instrument includes one of a decoding circuit and decoding software for interpreting the acoustical pulse generated by the remote control.

3. The hearing instrument system of claim 2, wherein the decoding circuit or decoding software includes a high pass filter for removing interfering energy, a full-wave rectifier followed by a low-pass filter for transforming the acoustical pulses into base band pulses, and programming for measuring the time spacing of the acoustical pulses to verify that the received pulses match a pulse pattern associated with a command for the hearing instrument.

4. A hearing instrument system comprising:

a hearing instrument having programming;

a wireless remote control configured to emit a mechanically generated acoustical pulse, wherein the programming of the hearing instrument is configured to interpret the acoustical pulse to program the hearing instrument and the programming of the hearing instrument includes one of a decoding circuit and decoding software for interpreting the acoustical pulse generated by the remote control, with the decoding circuit or decoding software including a high pass filter for removing interfering energy, a full-wave rectifier followed by a low-pass filter for transforming the acoustical pulses into base band pulses, and programming for measuring the time spacing of the acoustical pulses to verify that the received pulses match a pulse pattern associated with a command for the hearing instrument; and further comprising programming for disabling the decoding circuit, wherein the programming for disabling the decoding circuit comprises means for calculating a pulse-to-noise ratio at the output of the low-pass filter to determine whether the pulse-to-noise ratio exceeds a predetermined threshold.

5. The hearing instrument system of claim 4, wherein the wireless remote control is passive and the hearing instrument includes a built-in microphone, with the microphone being configured to accept the acoustical pulses from the remote control to effect control of the hearing instrument.

6. The hearing instrument system of claim 4, wherein the wireless remote control comprises:

a housing; and a mechanism associated with the housing for mechanically generating the acoustical pulse for effecting control of the hearing instrument.

7. The hearing instrument system of claim 6, wherein the mechanism is a finger actuatable member coupled to a reed.

8. The hearing instrument system of claim 6, wherein the mechanism comprises at least one cogged wheel that is rotationally positioned in the housing and at least one reed cantilevered to contact each cogged wheel, wherein each coupled wheel and reed are together configured to generate an acoustical pulse upon rotation of the wheel against the reed.

9. The hearing instrument system of claim 8, wherein the reed is fixed to a surface inside the housing; and the at least one cogged wheel comprises a plurality of cogged wheels, with each wheel being coupled to the at least one reed for generating a unique acoustical pulse associated with each of the plurality of cogged wheels.

10. The hearing instrument system of claim 9, wherein the plurality of cogged wheels includes at least a first cogged wheel, a second cogged wheel, and a third cogged wheel, with the first cogged wheel having a first spacing of cogs on the wheel, the second cogged wheel having a second spacing of cogs on the wheel, and the third cogged wheel having a third spacing of cogs on the wheel, with the first, second, and third spacings each being different from one another.

11. The hearing instrument system of claim 6, wherein the mechanism comprises at least one sliding push button having a surface treatment coupled to a reed for generating an acoustical pulse upon movement of the push button.

12. The hearing instrument system of claim 11, wherein the sliding push button comprises a bar-like member and the surface treatment comprises a plurality of cogs, and the reed is cantilevered in the housing so that one end of the reed is associated with the cogs for vibratory movement relative thereto.

13. The remote control of claim 12, wherein the at least one sliding push button comprises a plurality of push buttons.

14. The remote control of claim 6, further comprising indicia on the housing.

15. A method for controlling a hearing instrument comprising:

generating a remote acoustical pulse;

receiving the acoustical pulse through a microphone of a hearing instrument;

decoding the acoustical pulse in a program of a hearing instrument;

controlling the hearing instrument based upon the decoded acoustical pulse, and disabling the decoding step based upon the calculation of a pulse-to-noise ratio and comparison of that input to a predetermined threshold in order to determine whether a false triggering has occurred.

16. The method of claim 15, wherein the decoding the pulse step comprises utilizing a decoding circuit or decoding software programmed in the hearing instrument and the disabling the decoding step comprises disabling the decoding circuit or decoding software.

17. The method of claim 16, wherein the decoding the pulse step further comprises high-pass filtering the acoustical pulses received by the microphone to remove interfering energy, full-wave rectifying and low-pass filtering the acoustical pulses into base band pulses, and determining the time spacing of the band pulses to verify that the band pulses match a pattern associated with a command for the hearing instrument.

18. A method for controlling a hearing instrument comprising:

generating a remote acoustical pulse;

receiving the acoustical pulse through a microphone of a hearing instrument;

decoding the acoustical pulse in a program of a hearing instrument;

controlling the hearing instrument based upon the decoded acoustical pulse, and disabling the decoding step based upon the calculation of an input and comparison of that input to a predetermined threshold in order to determine whether a false triggering has occurred.

wherein the disabling the decoding step comprises determining that a false triggering has occurred, with the false triggering being determined by calculating a pulse-to-noise ratio and comparing the ratio to a predetermined threshold such that when the threshold is exceeded, the decoding step is disabled.

* * * * *